United States Patent [19]

Renzi

[11] Patent Number: 4,993,171

[45] Date of Patent: Feb. 19, 1991

[54] COVERING FOR A HYDRAULIC RAM OF A FREEZE DRYER

[75] Inventor: Ernesto Renzi, Youngstown, N.Y.

[73] Assignee: The BOC Group, Inc., New Providence, N.J.

[21] Appl. No.: 440,919

[22] Filed: Nov. 22, 1989

[51] Int. Cl.[5] ..... F26B 13/30

[52] U.S. Cl. ..... 34/92; 432/205; 34/9.5; 34/13.8

[58] Field of Search ..... 432/206, 205, 241; 34/92, 9.5, 13.8

[56] References Cited

U.S. PATENT DOCUMENTS

| | | | |
|---|---|---|---|
| 1,328,658 | 1/1920 | Fish, Jr. | 34/9.5 |
| 3,971,875 | 7/1976 | Regalbuto | 432/241 |
| 3,986,268 | 10/1976 | Koppelman | 34/13.8 |
| 4,102,637 | 7/1978 | Kneider et al. | 432/205 |
| 4,233,752 | 11/1980 | Kleinguenther | 34/13.8 |
| 4,802,654 | 2/1989 | Bozhko et al. | 432/205 |

*Primary Examiner*—Henry C. Yuen
*Attorney, Agent, or Firm*—Robert I. Pearlman; David M. Rosenblum

[57] ABSTRACT

The present invention provides a covering for a hydraulic ram of a freeze dryer. The freeze dryer of the present invention includes a pressure vessel having a sterile freeze drying chamber for receiving a stack of containers holding a sterile material to be freeze dried. A pressure plate located within the freeze drying chamber is adapted to be driven against the stack of containers for mechanically stoppering the containers. A hydraulic ram is connected to the pressure vessel and has an actuating arm projecting into the freeze drying chamber. The actuating arm is connected to the pressure plate and is extendible for driving the pressure plate against the containers and retractable for removal of the containers from the pressure vessel. The actuating arm has a non-sterile surface that could contaminate the freeze drying chamber and therefore, the sterile material could be freeze dried. In accordance with the present invention, an elongated covering, preferably in the form of a welded steel bellows, sealably connected at one end, to the pressure vessel and, at the other end, to the pressure plate isolates the non-sterile surface of the actuating arm to prevent contamination of the sterile material to be freeze dried.

3 Claims, 2 Drawing Sheets

COVERING FOR A HYDRAULIC RAM OF A FREEZE DRYER

BACKGROUND OF THE INVENTION

The prior art has provided freeze dryers incorporating a pressure vessel having a freeze drying chamber for receiving sterile material to be freeze dried. The sterile material is held within a plurality of containers which are sealed by loosely fitted stoppers adapted to be mechanically driven into the containers after the material is freeze dried. The containers are stacked upon a collapsible stack of trays located within the freeze drying chamber and a pressure plate is provided to push the shelves and containers together in order to drive the stoppers into the containers. The pressure plate is in turn driven by an actuating arm of a double-acting hydraulic ram connected to the pressure vessel. Actuation of the hydraulic ram in one direction produces an extension of the actuating arm to press the pressure plate against the containers and shelves and actuation of the hydraulic ram in an opposite direction produces a retraction of the actuating arm in order to remove the containers from the shelves and the pressure vessel.

The sterility of the freeze drying chamber is maintained by a variety of well known methods. However, there is no assurance that the sterility of the hydraulic ram is maintained since extension and retraction of the actuating arm is effectuated by a hydraulic cylinder located outside of the freeze drying chamber. The hydraulic cylinder can coat the outer surface of the actuating arm with oil or other contaminants. As a result, the non-sterile surface of the actuating arm can introduce contaminants into the freeze drying chamber and can thereby contaminate the sterile material to be freeze dried.

SUMMARY OF THE INVENTION

The present invention provides a freeze dryer including a pressure vessel having a sterile freeze drying chamber for receiving a stack of containers holding a sterile material to be freeze dried. A pressure plate, located within the freeze drying chamber, is adapted to be driven against the stack of containers for mechanically stoppering the containers. A double-acting hydraulic ram, connected to the pressure vessel, has an actuating arm projecting into the freeze drying chamber and connected to the pressure plate. The actuating arm is extendible for driving the pressure plate against the containers and retractable for removal of the containers from the pressure vessel. As mentioned above, the actuating arm has a non-sterile surface. In accordance with the present invention, elongated covering means are provided that is configured to expand and contract with extension and retraction of the actuating arm and covers the non-sterile surface of the actuating arm for preventing contamination of the sterile material.

BRIEF DESCRIPTION OF THE DRAWINGS

Although specification includes with claims particularly pointing out the subject matter the Applicant regards as his invention, it is believed that the invention will be better understood from the following description taken in conjunction with the accompanying drawings in which:

DETAILED DESCRIPTION

Figure 1:
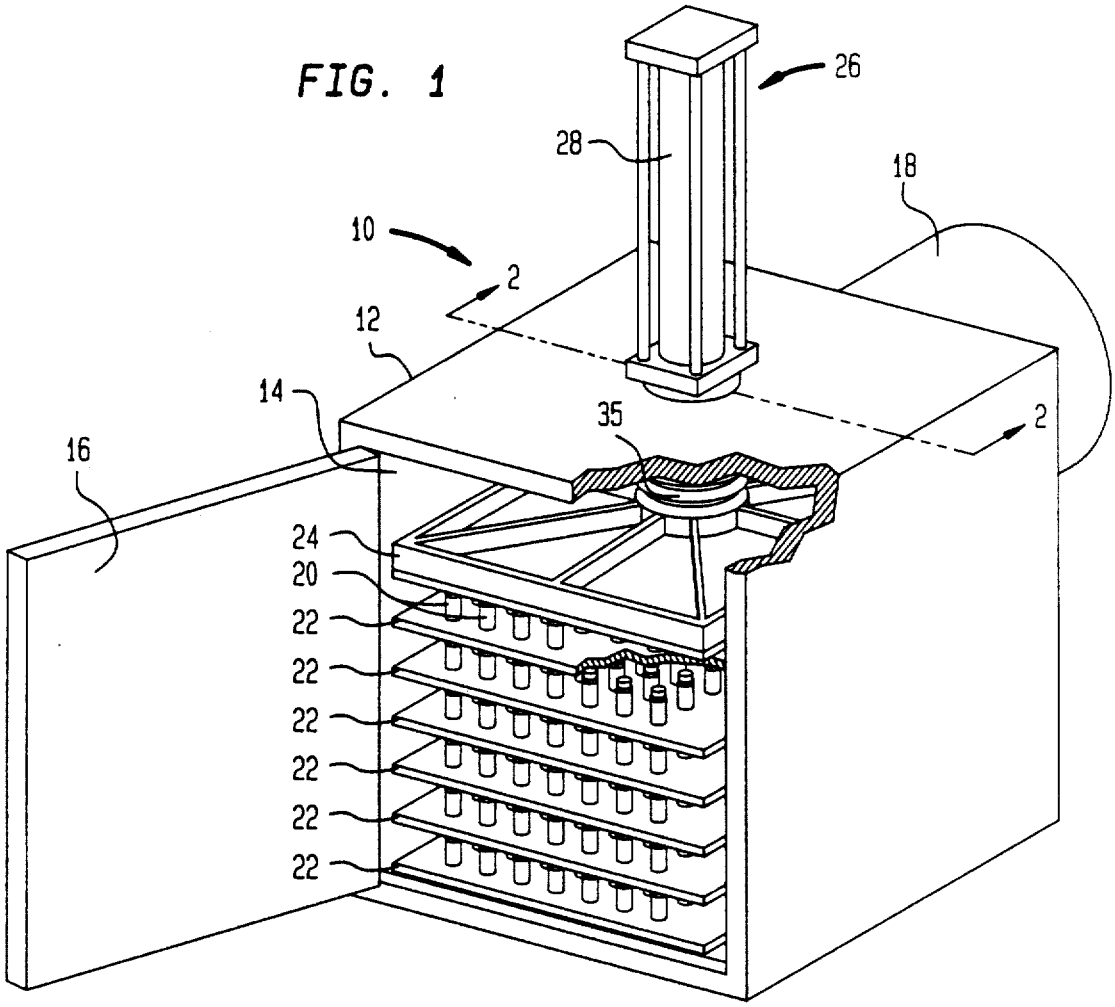
FIG. 1 is a prospective view of a pressure vessel of a freeze dryer.
Figure 2:
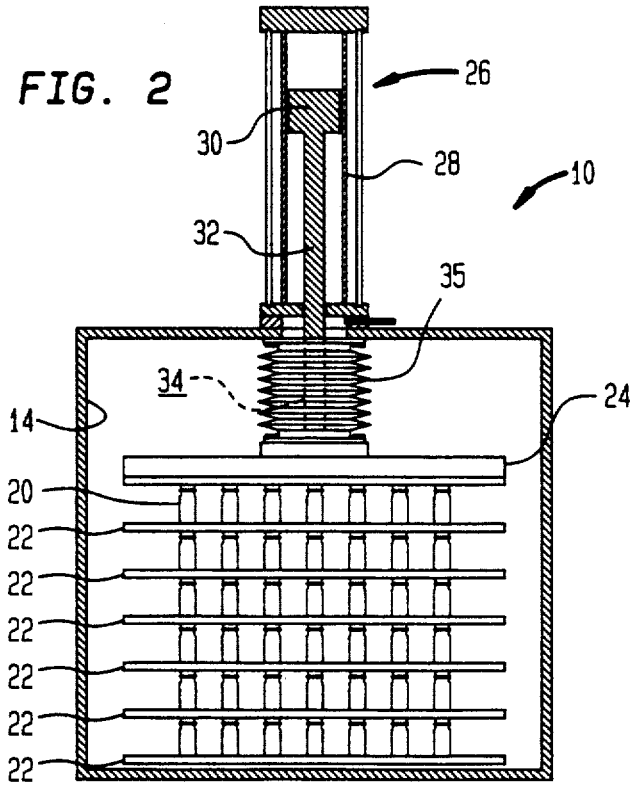
FIG. 2 is a cross-sectional view of FIG. 1 taken along line 2—2 of FIG. 1.

With reference to FIGS. 1 and 2, a freeze dryer 10 is illustrated incorporating the improvement of the present invention. Freeze dryer 10 includes a pressure vessel 12 having a freeze drying chamber 14. It is understood that although pressure vessel 12 and freeze drying chamber 14 is indicated as being of cubic configuration, the present invention also as application to freeze dryers incorporating pressure vessels and freeze drying chambers of cylindrical configuration. A hinged door 16, when closed, seals freeze drying chamber 14. Additionally, freeze dryer 10 is also provided with an ice condenser 18 which is connected to a vacuum pump for subjecting freeze drying chamber 14 to a subatmospheric pressure in the freeze drying of a sterile material.

The sterile material to be freeze dried is held within a plurality of containers 20 located upon a vertical stack of collapsible shelves 22. Containers 20 are of the well known type that are sealed by stoppers that are initially loosely fitted to the containers. After the sterile material is freeze dried, the stoppers are mechanically driven into containers 20 through use of a pressure plate 24 that presses against containers 20 and shelves 22. After such mechanical stoppering of the containers, pressure plate 24 is upwardly retracted for removal of containers 20 from freeze drying chamber 14.

Pressure plate 24 is driven against containers 20 and shelves 22 by means of a double-acting hydraulic ram 26. Hydraulic ram 26 has a hydraulic cylinder 28 to reciprocate a piston 30 in upward and downward directions. Piston 30 in turn extends an actuating arm 32 projecting into freeze drying chamber 14 and connected to pressure plate 24.

As mentioned previously, the contents of containers 20 are sterile. However, the outer surface 34 of actuating arm 32 is not sterile. The reason for this is that as actuating arm 32 is extended and retracted within cylinder 28, it is coated by oil used in driving piston 30. Moreover, since the interior of hydraulic cylinder 28 is not sterile in the first instance, contaminants in addition to hydraulic fluid may also be imparted to actuating arm 32.

In accordance with the present invention, non-sterile surface 34 is isolated from the sterile environment of freeze drying chamber 14 to prevent contamination of the sterile contents held within containers 20 by a covering which is preferably formed by an elongated welded steel sealing bellows 35, fabricated from type AMS 350 stainless steel. Such bellows may be obtained from Huntington Laboratories, Inc., 1040 L'Avenida, Mountainview, Calif. 94043.

Figure 3:
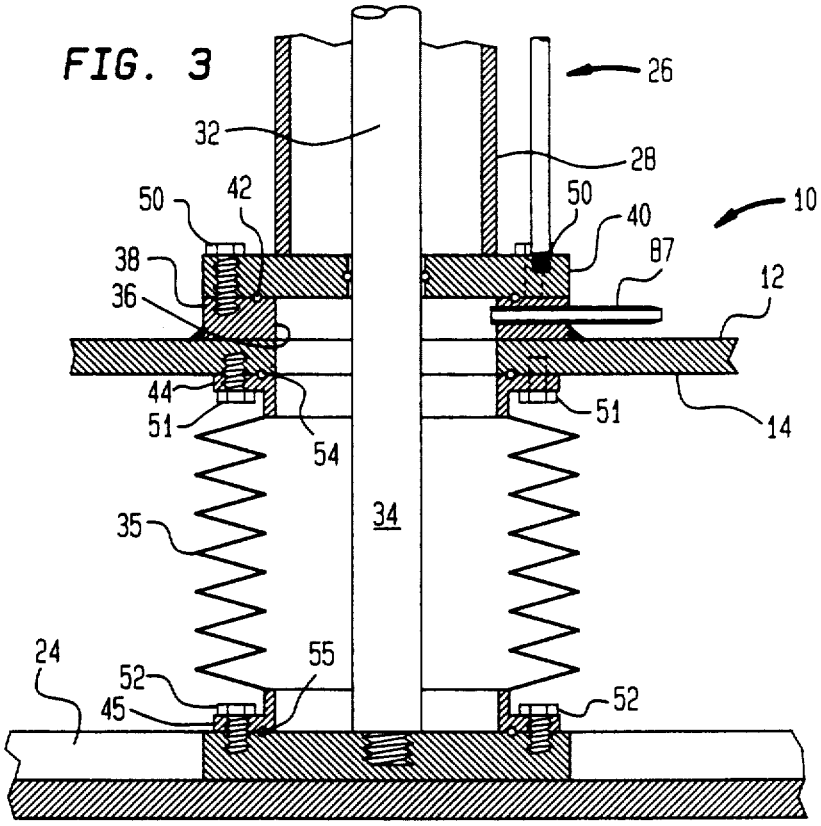
FIG. 3 is an enlarged fragmentary cross-sectional view of FIG. 2 illustrating the attachment of a sealing bellows in accordance with the present invention between the pressure plate and the pressure vessel of the freeze dryer.

With reference to FIG. 3 a circular opening 36 is provided at the top of pressure vessel 12 that communicates between its outside surface and freeze drying chamber 14. An annular flange 38 is welded to pressure vessel 12 in a coaxial relationship with opening 36. A bottom flange 40 of hydraulic ram 26 is then attached to annular flange 38 by a set of bolts 50. Annular gasket 42 provides a seal between bottom flange 40 and annular flange 38.

A pair of top and bottom flanges 44 and 45 are welded to the ends of sealing bellows 35. Top flange 44 is bolted to pressure vessel 12 by a set of bolts 51. Bottom flange 45 is bolted by a set of bolts 52 to pressure plate 24. Top and bottom gaskets 54 and 55 respectively provide a seal between pressure vessel 12 and top flange 44 and pressure plate 24 and bottom flange 45. Since bellows 35 expands and contracts with the extension and retraction of actuating arm 32, the volume within bellows 34 increases and decreases. In order to allow free expansion and contraction of bellows 48, a breather pipe 87 may be provided. However, to insure that ambient air cannot even possibly contaminate the interior of freeze drying chamber, breather pipe 87 can be eliminated. In this regard, the preferred welded steel bellows, obtained from Huntington Laboratories, Inc., have been formed to be capable of expanding and contracting with actuating arm 32, without failure, even without provision of breather pipe 87.

Figure 4:
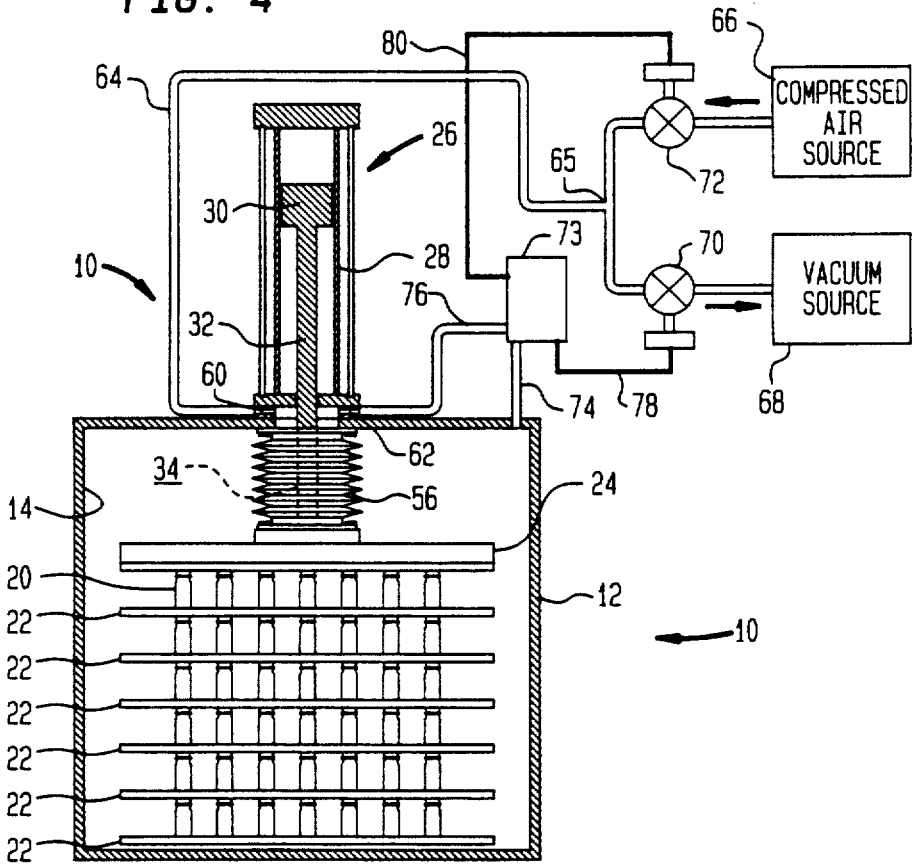
FIG. 4 is a cross-sectional view of an alternative embodiment of a freeze dryer in accordance with the present invention.

With reference now to FIG. 4, an elastomeric bellows 56 may be incorporated into freeze dryer 10 in place of sealing bellows 35. Elastomeric bellows 56 is connected at one end to pressure plate 24 and at the other end to the top of pressure vessel 12 in the same manner as sealing bellows 35. However, although sealing bellows 35 is designed to be insensitive to external pressure change, elastomeric bellows 56 is sensitive and may become overstressed and burst upon the reduction of pressure within freeze drying chamber 14 due to the subatmospheric pressure within freeze drying chamber 14 created by the vacuum pump. Therefore, in accordance with the present invention, means are provided to equalize the pressure within bellows 56 and freeze drying chamber 14. To such pressure equalization ends, the annular flange used to connect the bottom flange of hydraulic cylinder 26 to the top of pressure vessel 12 is provided with a transfer pipe 60 to pressurize and depressurize the interior of bellows 56 and a sensing pipe 62 to sense the pressure within bellows 56. Transfer and sensing pipes 60 and 62 are identical to breather pipe 87 provided for in the installation of sealing bellows 35. The pressurization and depressurization of bellows 56 is accomplished through the use of an air line 64 connecting transfer pipe 60 to the central branch of a 'Y' junction 65 which is in turn connected to a compressed air source 66 and a vacuum source 68. Inline pneumatic air valves 70 and 72 are selectively actuated to apply compressed air and vacuum through 'Y' Junction 65, air line 64, transfer pipe 60 to the interior of bellows 56.

Actuation of pneumatic air valves 70 and 72 is automatically controlled by a differential pressure switch 73, preferably a Model RT 262A pressure switch manufactured by DANFOSS of 6430 Nordborg, Denmark. Switch 73 senses pressure within freeze drying chamber 14 through a sensing line 74 and pressure within bellows 56 through a sensing line 76 connected to sensing pipe 62. Pressure switch 73 actuates a changeover contact according to whether the pressure on one side is greater or less than the presure on the other side. There is a dead zone where the pressures are equal. In the event that the pressure in freeze drying chamber 14 is less than that within sealing bellows 56, pressure switch 73 activates air valve 70 through electrical lead 78 and vacuum from vacuum source 68 acts through the 'Y' junction 65 and line 64 to decrease the pressure within bellows 56. In the event that the pressure within freeze drying chamber 14 is greater than bellows 56, pressure switch 73 activates air valve 72 through electrical lead 80 and compressed air is supplied from compressed air source 66 to line 64 and the interior of bellows 56. It should be mentioned that vacuum source 68 may be the vacuum pump of freeze dryer 10.

The equalization of pressure between the inside of bellows 56 with that of freeze drying chamber 14 also permits contraction and expansion of bellows 56. For instance, as bellows 56 contracts, since its volume decreases, its inside pressure increases. However, the inside pressure of bellows 57 is maintained equal to that of freeze drying chamber 14. Therefore, the increase in pressure of bellows 56 represents an increase over the pressure within freeze drying chamber 14. As a result, bellows 56 vents through air valve 70 in an attempt of pressure switch 73 to equalize pressure. As bellows 56 expands, its inside pressure decreases from a pressure equal to the pressure within freeze drying chamber 14. In such case, switch 73 sets air valve 72 into an open condition and compressed air from compressed air source 66 enters bellows 56 to allow expansion.

While preferred embodiments of the invention have been shown and described in detail, it will be readily understood and appreciated by those skilled in the art that numerous omissions, changes and additions may be made without departing from the spirit and scope of the invention.

I claim:

1. In a freeze dryer of the type including: a pressure vessel having a sterile freeze drying chamber for receiving a stack of containers holding a sterile material to be freeze dried; a pressure plate located within the freeze drying chamber and adapted to be driven against the stack of containers for mechanically stoppering the containers; and a double-acting hydraulic ram connected to the pressure vessel and having an actuating arm projecting into the freeze drying chamber and connected to the pressure plate, the actuating arm extendible for driving the pressure plate against the containers, retractable for removal of the containers from the pressure vessel, and having a non-sterile surface, the improvement comprising;

elongated covering means configured to expand and contract with extension and retraction of the actuating arm, and covering the non-sterile surface of the actuating arm for preventing contamination of the freeze drying chamber and therefore, the sterile material by the non-sterile surface of the actuating arm.

2. The improvement of claim 1 wherein:

the freeze dryer also includes vacuum means for producing a subatmospheric pressure in the freeze drying chamber during the freeze drying of the sterile material; and said elongated covering means comprises a welded steel bellows sealably connected, at one end, to the pressure vessel and, at the other end, to the pressure plate and configured to withstand the subatmospheric pressure of the vacuum means without failure.

3. The improvement of claim 1 wherein..

the freeze dryer also includes vacuum means for producing a subatmospheric pressure in the freeze drying chamber during the freeze drying of the sterile material; and the elongated covering means comprises:

an elastomeric bellows sealably connected, at one end, to the pressure vessel and, at the other end, to the pressure plate;

sensing means in communication with the inside of the elastomeric bellows and the freeze drying chamber for sensing the pressure difference between the inside of the elastomeric bellows and the freeze drying chamber; and pressure equalization means in communication with the inside of the bellows and responsive to the sensing means for setting the inside pressure of the bellows equal to the freeze drying chamber to prevent failure of the elastomeric bellows and to permit expansion and contraction thereof with extension and retraction of the actuating arm.

* * * * *

US004993171B1

REEXAMINATION CERTIFICATE (2939th)

United States Patent [19] [11] B1 4,993,171

Renzi [45] Certificate Issued Jul. 2, 1996

[54] COVERING FOR A HYDRAULIC RAM OF A FREEZE DRYER

[75] Inventor: Ernesto Renzi, Youngstown, N.Y.

[73] Assignee: BOC Group, Inc., Murray Hill, N.J.

Reexamination Request:
No. 90/003,871, Jun. 23, 1995

Reexamination Certificate for:

| | |
|---|---|
| Patent No.: | **4,993,171** |
| Issued: | **Feb. 19, 1991** |
| Appl. No.: | **440,919** |
| Filed: | **Nov. 22, 1989** |

[51] Int. Cl.[6] ..... F26B 13/30

[52] U.S. Cl. ..... 34/92; 432/205; 34/9.5; 34/13.8

[58] Field of Search ..... 432/205

[56] References Cited

U.S. PATENT DOCUMENTS

| | | | |
|---|---|---|---|
| 1,328,658 | 1/1920 | Fish, Jr. | 34/9.5 |
| 3,625,378 | 12/1971 | Attiz | 214/1 CM |
| 3,971,875 | 7/1976 | Regalbuto | 432/241 |
| 3,986,268 | 10/1976 | Koppelman | 34/13.8 |
| 4,102,637 | 7/1978 | Kreider et al. | 432/205 |
| 4,233,752 | 11/1980 | Kleinguenther | 34/13.8 |
| 4,363,217 | 12/1982 | Venuti | 62/55.5 |
| 4,781,520 | 11/1988 | Balter | 414/751 |
| 4,802,654 | 2/1989 | Bazhko et al. | 432/205 |
| 4,961,273 | 10/1990 | Fay | 34/92 |

*Primary Examiner*—Thomas N. Moulis

[57] ABSTRACT

The present invention provides a covering for a hydraulic ram of a freeze dryer. The freeze dryer of the present invention includes a pressure vessel having a sterile freeze drying chamber for receiving a stack of containers holding a sterile material to be freeze dried. A pressure plate located within the freeze drying chamber is adapted to be driven against the stack of containers for mechanically stoppering the containers. A hydraulic ram is connected to the pressure vessel and has an actuating arm projecting into the freeze drying chamber. The actuating arm is connected to the pressure plate and is extendible for driving the pressure plate against the containers and retractable for removal of the containers from the pressure vessel. The actuating arm has a non-sterile surface that could contaminate the freeze drying chamber and therefore, the sterile material could be freeze dried. In accordance with the present invention, an elongated covering, preferably in the form of a welded steel bellows, sealably connected at one end, to the pressure vessel and, at the other end, to the pressure plate isolates the non-sterile surface of the actuating arm to prevent contamination of the sterile material to be freeze dried.

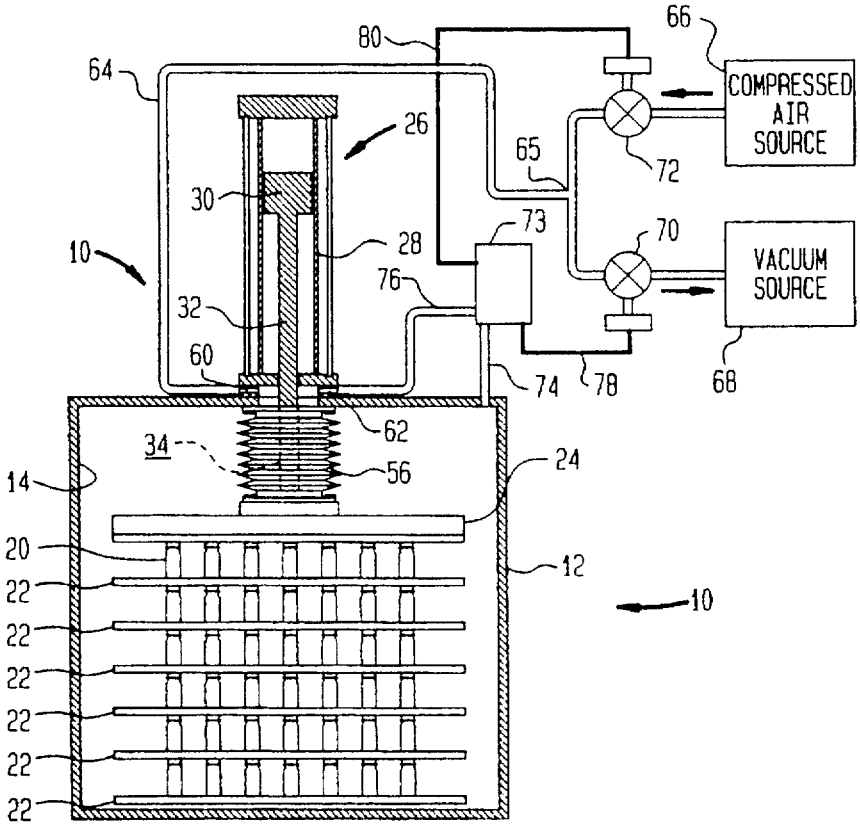

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 3 is confirmed.

Claims 1–2 are cancelled.

* * * * *